US006874478B2

(12) United States Patent
Minoura et al.

(10) Patent No.: US 6,874,478 B2
(45) Date of Patent: Apr. 5, 2005

(54) FUEL SUPPLY UNIT AND ASSEMBLING METHOD THEREOF

(75) Inventors: Yousuke Minoura, Novi (JP); Kouzou Nakada, Okazaki (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/606,942

(22) Filed: Jun. 27, 2003

(65) Prior Publication Data

US 2004/0045532 A1 Mar. 11, 2004

(30) Foreign Application Priority Data

Jun. 28, 2002 (JP) ..... 2002-189348

(51) Int. Cl.[7] ..... F02M 55/02
(52) U.S. Cl. ..... 123/470
(58) Field of Search ..... 123/470, 456, 123/468, 469, 467, 466

(56) References Cited

U.S. PATENT DOCUMENTS 5,771,863 A * 6/1998 Daly ..... 123/456
5,803,052 A * 9/1998 Lorraine et al. ..... 123/470
6,053,149 A * 4/2000 Lorraine ..... 123/470
6,374,809 B2 * 4/2002 Satou ..... 123/470
6,481,420 B1 * 11/2002 Panasuk et al. ..... 123/470
6,637,411 B2 * 10/2003 Makiyama ..... 123/470
6,705,292 B2 * 3/2004 Bugos ..... 123/470

FOREIGN PATENT DOCUMENTS

JP A-9-291866 11/1997

* cited by examiner

*Primary Examiner*—Mahmoud Gimie
(74) *Attorney, Agent, or Firm*—Nixon & Vanderhye PC

(57) ABSTRACT

A fuel supply unit includes a fuel distribution pipe, a fuel injector and a locking clip. The fuel distribution pipe has a fuel outlet port, and the fuel injector has a fuel inlet port. The fuel inlet port is communicated with the fuel outlet port. The locking clip is for preventing the fuel injector from detaching from the fuel distribution pipe. The fuel injector has a projecting lockable injector portion in a circumference thereof. The locking clip has a locking portion extending along a circumference of the injector within a circumferential length thereof. When the fuel injector is moved in a direction of detaching the fuel inlet port from the fuel outlet port, the locking clip locks the fuel distribution port, and a middle portion of the locking portion locks the lockable injector portion. Therefore, the locking clip prevents fuel injector from detaching from the fuel distribution pipe.

14 Claims, 10 Drawing Sheets

FIG. 7A
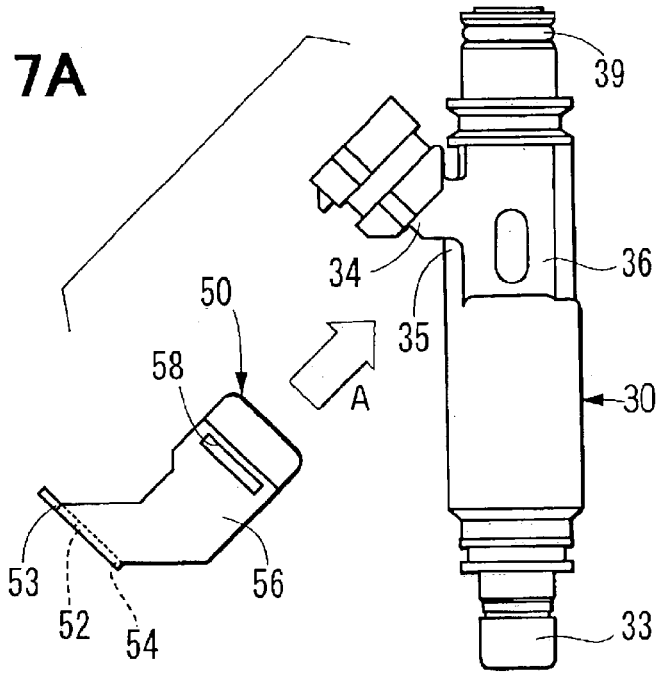
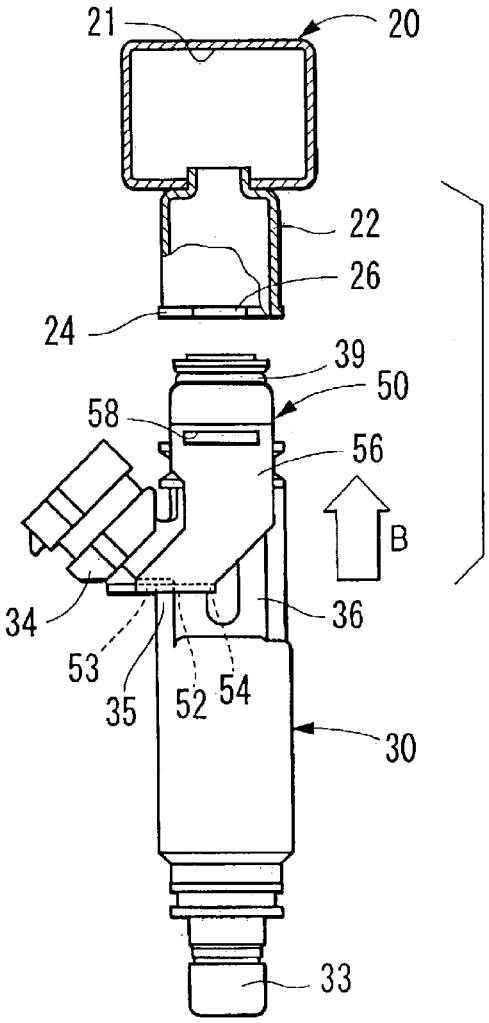
FIG. 7B

FUEL SUPPLY UNIT AND ASSEMBLING METHOD THEREOF

CROSS REFERENCE TO RELATED APPLICATION

This application is based on Japanese Patent Application No. 2002-189348 filed on Jun. 28, 2002, the disclosure of which is incorporated herein by reference.

BACKGROUND OF THE INVENTION

1. Field of the Invention

The present invention relates to a fuel supply unit of an engine of an automobile, in which a fuel injector installed in a fuel distribution pipe injects fuel to a cylinder of the engine.

2. Description of Related Art

Heretofore, a fuel supply unit includes a fuel injector for injecting fuel to a cylinder of an engine and a fuel distribution pipe for distributing fuel to the injector. The fuel distribution pipe has a fuel outlet port, and the fuel injector has a fuel inlet port, so that the fuel outlet port and the fuel inlet port are communicated. The fuel injector is clamped between the fuel distribution pipe and the engine.

In the fuel supply unit, the fuel injector is likely to be detached from the fuel distribution pipe by a shock to the engine or the fuel injector caused by, for example, a car clash. Since the fuel injector is detachable from the fuel distribution pipe, it is difficult to transport the fuel supply unit in which the fuel injector is installed in the fuel distribution pipe before the fuel supply unit is installed in the engine.

Accordingly, a fuel supply unit 100 shown in FIGS. 10A and 10B, which has a structure to restrict a detachment of the fuel injector from the fuel distribution pipe, is proposed. The fuel supply unit 100 includes a locking clip 205, a fuel injector 203 and a fuel distribution pipe 200. The locking clip 205 restricts the fuel injector 203 from detaching from the fuel distribution pipe 200. The locking clip 205 includes a couple of parallel distribution pipe locking portions 206.

As shown in FIG. 10A, each locking portion 206 has a locking hole 207 in the upper part thereof. The fuel outlet port 201 of the fuel distribution pipe 200 has a circular flange 202. A corresponding part of the circular flange 202 fits in the locking hole 207. Accordingly, the circular flange 202 is fastened to the respective locking portion 206. The locking portion 206 has a locking flange 208 in the lower end thereof. The locking flange 208 extends toward the opposing locking portion 206. Each locking flange 208 fits on a circumferential surface of the fuel injector 203.

As shown in FIG. 10B, each flange 208 has a locking projection 209 extending from the end thereof toward the opposing locking flange 208, and the fuel injector 203 has a lockable portion 204, so that the locking projections 209 are locked in the lockable portion 204. In this way, the fuel injector 203 is prevented from being detached from the fuel distribution pipe 200.

However, the locking clip 205 locks the lockable portion 204 of the fuel injector 203 only by the two separated locking projections 209. Therefore, when the locking projections 209 are forcedly weighted with the lockable portion 204, the locking projections 209 are deformed and detached from the lockable portion 204. That is, the fuel injector 203 is detached from the locking clip 205. Otherwise, when the locking portions 206 are forcedly pulled in a right direction in FIG. 10A, the locking projections 209 are detached from the lockable portions 204.

Moreover, as shown in FIGS. 11A and 11B, when a rotational force β is generated in the locking portion 206 by the lockable portion 204 of the fuel injector 203, with which the locking projection 209 contacts, the inner peripheral surface of the locking hole 207 is rotationally pressed by the circular flange 202. Accordingly, as shown in FIGS. 11C and 11D, both peripheral edges 202*a* of the circular flange 202 are pressed by the peripheral edge of the locking hole 207, so that the locking hole 207 of the locking portion 206 is deformed, and a force for detaching the circular flange 202 from the locking hole 207 is generated. After all, the locking clip 205 is detached from the fuel distribution pipe 200 as shown in FIGS. 11E and 11F. That is, in the proposed fuel supply unit 100, the fuel injector 203 is still likely to be detached from the fuel distribution pipe 200.

SUMMARY OF THE INVENTION

It is an objective of the present invention to provide a fuel supply unit in which a fuel injector is surely prevented to be detached from a fuel distribution pipe and an assembling method thereof in which the fuel injector can be easily installed in the fuel distribution pipe.

According to the present invention, a fuel supply unit includes a fuel distribution pipe, a fuel injector and a locking clip. The fuel distribution pipe is for distributing fuel to a cylinder of an engine and has a fuel outlet port. The fuel injector is for injecting the fuel into the cylinder and includes a fuel inlet port and a lockable portion. The fuel outlet port and the fuel inlet port are communicated, and the fuel is supplied from the fuel distribution pipe to the fuel injector through the fuel outlet port and the fuel inlet port.

The locking clip is for preventing the fuel injector from detaching from the fuel distribution pipe. The locking clip includes an injector locking portion and is extended around the fuel injector within a circumferential length thereof, wherein the injector locking portion fits on a circumferential surface of the fuel injector without breaks. The locking clip is fastened to the fuel outlet port, and a middle portion of the injector locking portion in a circumferential direction thereof locks the lockable portion of the injector, so that the fuel inlet port is not detached from the fuel outlet port when the fuel injector is forcedly moved in a detaching direction thereof. In addition, the injector locking portion of the locking clip fits on the circumference of the fuel injector without the breaks. Therefore, when the middle part of the injector locking portion is forcedly pressed by the lockable portion, the injector locking portion is not deformed. That is, the injector is prevented to be detached from the locking clip.

Moreover, according to the present invention, the locking clip further includes a plurality of distribution pipe locking portions disposed along a circumference of the fuel outlet port, wherein each distribution pipe locking portion has a locking hole. The fuel outlet port has a plurality of lockable projections, each of which projects in a radial direction thereof from an outer circumference thereof. Both sides of each lockable projection are formed in parallel with a projecting direction thereof or formed so that width of each lockable projection gets larger in the projecting direction. Accordingly, when a rotational force around the locking hole is generated in the distribution pipe locking portion, and a peripheral inner surface of the locking hole is rotationally pressed thereby, a deformation of the distribution pipe locking portion, which makes the lockable projection detach from the locking hole, is restricted. That is, the fuel distribution pipe is surely prevented to be detached from the locking clip.

Furthermore, according to the present invention, an assembling method of the fuel supply unit includes two assembling steps. One of the steps is that the fuel injector is installed between the distribution pipe locking portions of the locking clip, and the injector locking portion is fit on the circumferential surface of the fuel injector. The other step is that the distribution pipe locking portions are deformed to be broadened from each other, and each of which is fit in the circumference of the fuel outlet port by deformation restricting force of the distribution pipe locking portion. In the assembling method, the fuel supply unit can be assembled easily.

BRIEF DESCRIPTION OF THE DRAWINGS

Other objects, features and advantages of the present invention will become more apparent from the following detailed description made with reference to the accompanying drawings, in which:

FIGS. 7A and 7B are views illustrating an assembling method of the fuel supply unit according to the first embodiment;

DETAILED DESCRIPTION OF THE PRESENTLY PREFERRED EMBODIMENTS

Preferred embodiments of the present invention will be described hereinafter with reference to the accompanying drawings.

(First Embodiment)

Figure 1A:
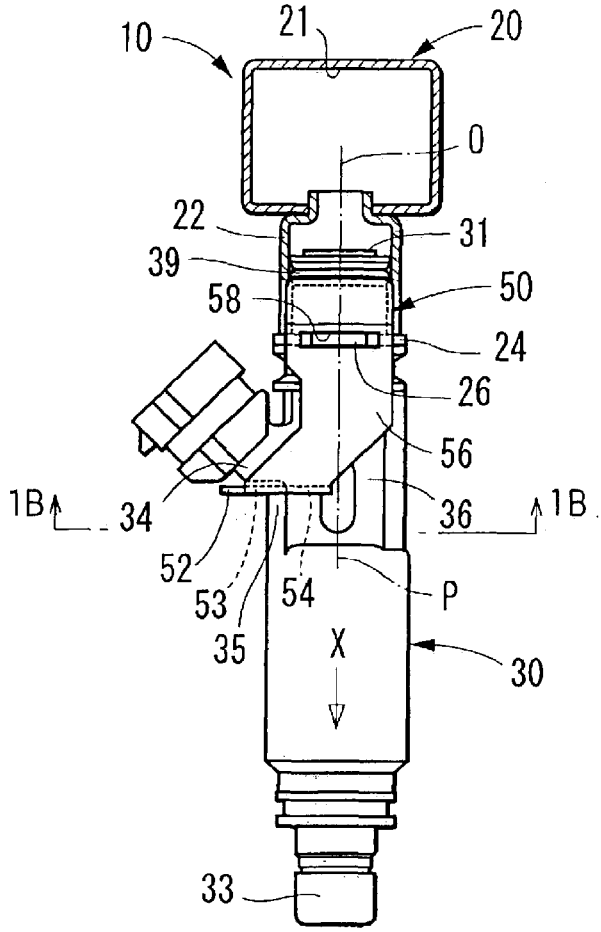
FIG. 1A is a partially cross-sectional side view of a fuel supply unit according to a first embodiment of the present invention.
Figure 1B:
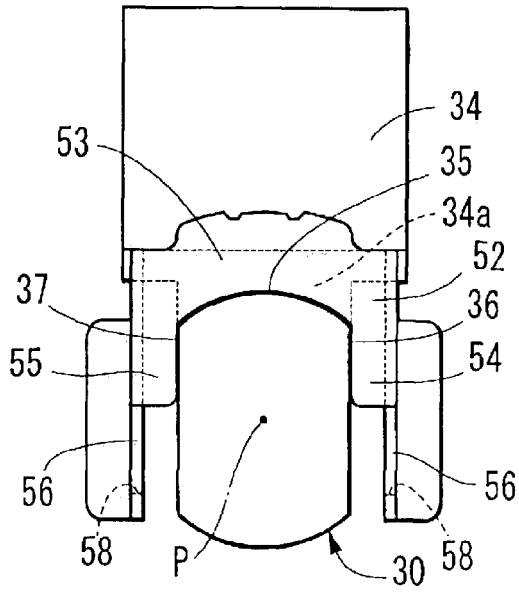
FIG. 1B is a schematic cross-sectional view of the fuel supply unit according to the first embodiment, which is taken along a 1B—1B line of FIG. 1A.
Figure 2:
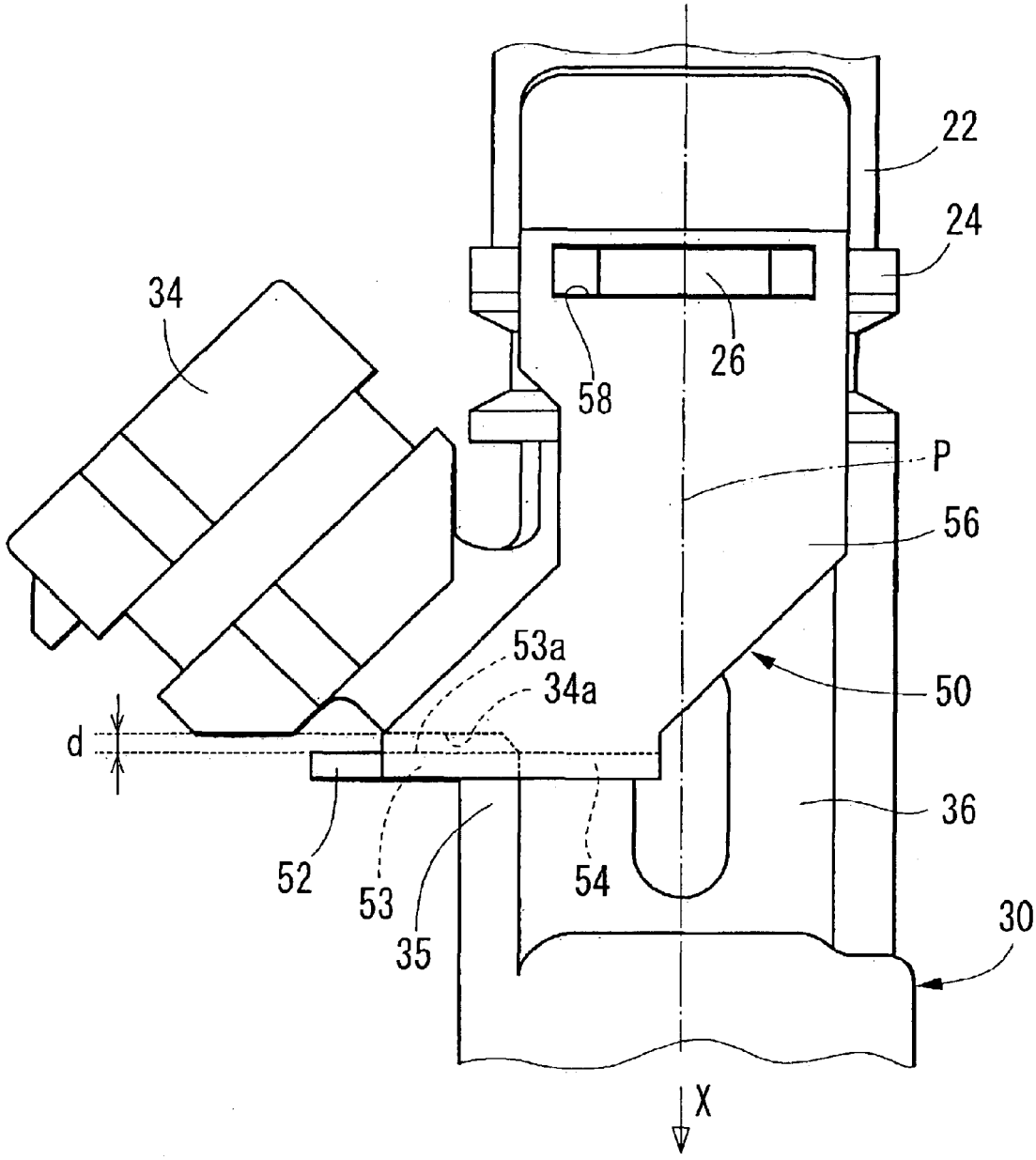
FIG. 2 is a partially enlarged view of a part of the fuel supply unit according to the first embodiment.

Referring to FIGS. 1A, 1B and 2, a fuel supply unit 10 includes a fuel distribution pipe 20, a fuel injector 30 and a locking clip 50. The fuel injector 30 is installed in the fuel distribution pipe 20, and the locking clip 50 prevents the fuel injector 30 from detaching from the fuel distribution pipe 20.

A fuel passage 21 is formed in the fuel distribution pipe 20. The fuel distribution pipe 20 is fixed to an engine (not shown) and has at least one fuel outlet port 22 for distributing fuel to a corresponding injector 30. The fuel outlet port 22 has a cylindrical shape and projects from the outer surface of the fuel distribution pipe 20. The inner passage of the fuel outlet port 22 is communicated with the fuel passage 21 of the fuel distribution pipe 20.

Figure 3A:
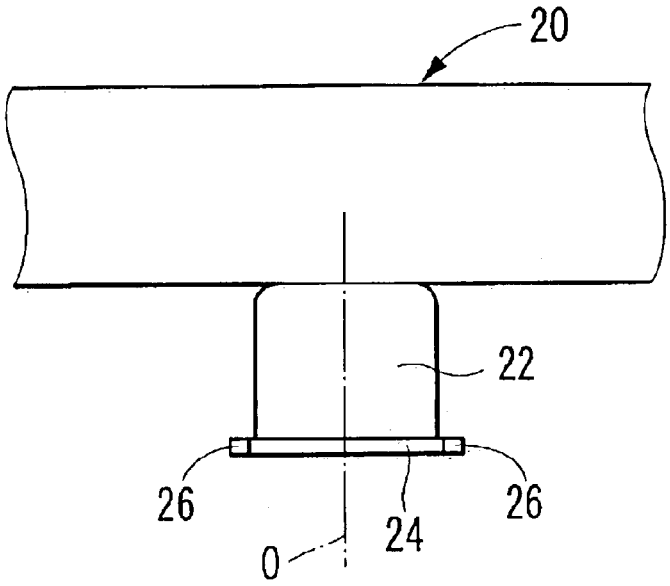
FIG. 3A is a front elevation view of a fuel distribution pipe of the fuel supply unit according to the first embodiment.
Figure 3B:
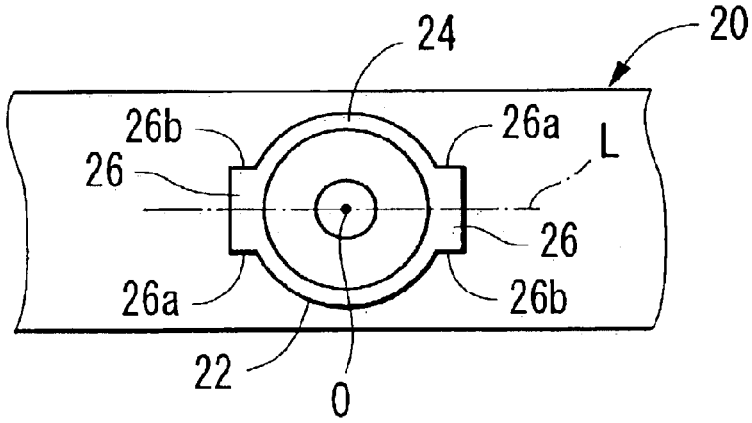
FIG. 3B is a plan bottom view of the fuel distribution pipe.

As shown in FIGS. 3A and 3B, the bottom end of the fuel outlet port 22 has a circular flange 24 continuously extending along a circumference of the end. The circular flange 24 has two lockable projections 26 in a circumference thereof, wherein the lockable projections 26 projects radially from two parts of the circumference. The two parts of the circumference are positioned symmetrically on a longitudinal central axis O. Moreover, both lockable projection sides 26*a*, 26*b* of each lockable projection 26 are parallel with a line L, which is parallel with a projecting direction of the corresponding lockable projection 26.

As shown in FIGS. 1A and 1B, the fuel injector 30 has a fuel inlet port 31, in which the fuel flows through the fuel outlet port 22. The fuel inlet port 31 has a substantially cylindrical shape, the inner passage of which is communicated with a fuel passage of the fuel injector 30. The fuel inlet port 31 is concentrically received in the fuel outlet port 22, wherein the fuel inlet port 31 can be moved in a direction P, which is a same axial direction as the fuel injector 30. The direction X shown in FIGS. 1A and 2 indicates a direction in which the fuel inlet port 31 is detached from the fuel outlet port 22. In a state where the fuel inlet port 31 is received in the fuel outlet port 22, the inner passage of the fuel inlet port 31 is communicated with the inner passage of the fuel outlet port 22. Therefore, the fuel in the fuel distribution pipe 20 is supplied to the fuel passage of the fuel injector 30 through the fuel outlet port 22 and the fuel inlet port 31. An O-ring 39 serving as a seal member is provided and seals a gap between the fuel inlet port 31 and the fuel outlet port 22. A nozzle 33 of the fuel injector 30 is received in the cylinder of the engine and sealed by a seal member (not shown).

The fuel injector 30 is an electric type. In the fuel injector 30, lift of a nozzle needle is controlled by controlling electricity supplied from a connector 34 to a coil therein, and the fuel supplied through the fuel passage of the fuel injector 30 is injected from the nozzle 33 into the cylinder. The connector 34 is integrally formed in an injector side surface 35 of the fuel injector 30, where the connector 34 projects outward from the fuel injector 30. As shown in FIG. 2, a plane 34*a* of the connector 34, which faces in the direction X, is perpendicular to a longitudinal axis (central axis) P of the injector 30.

Figure 4:
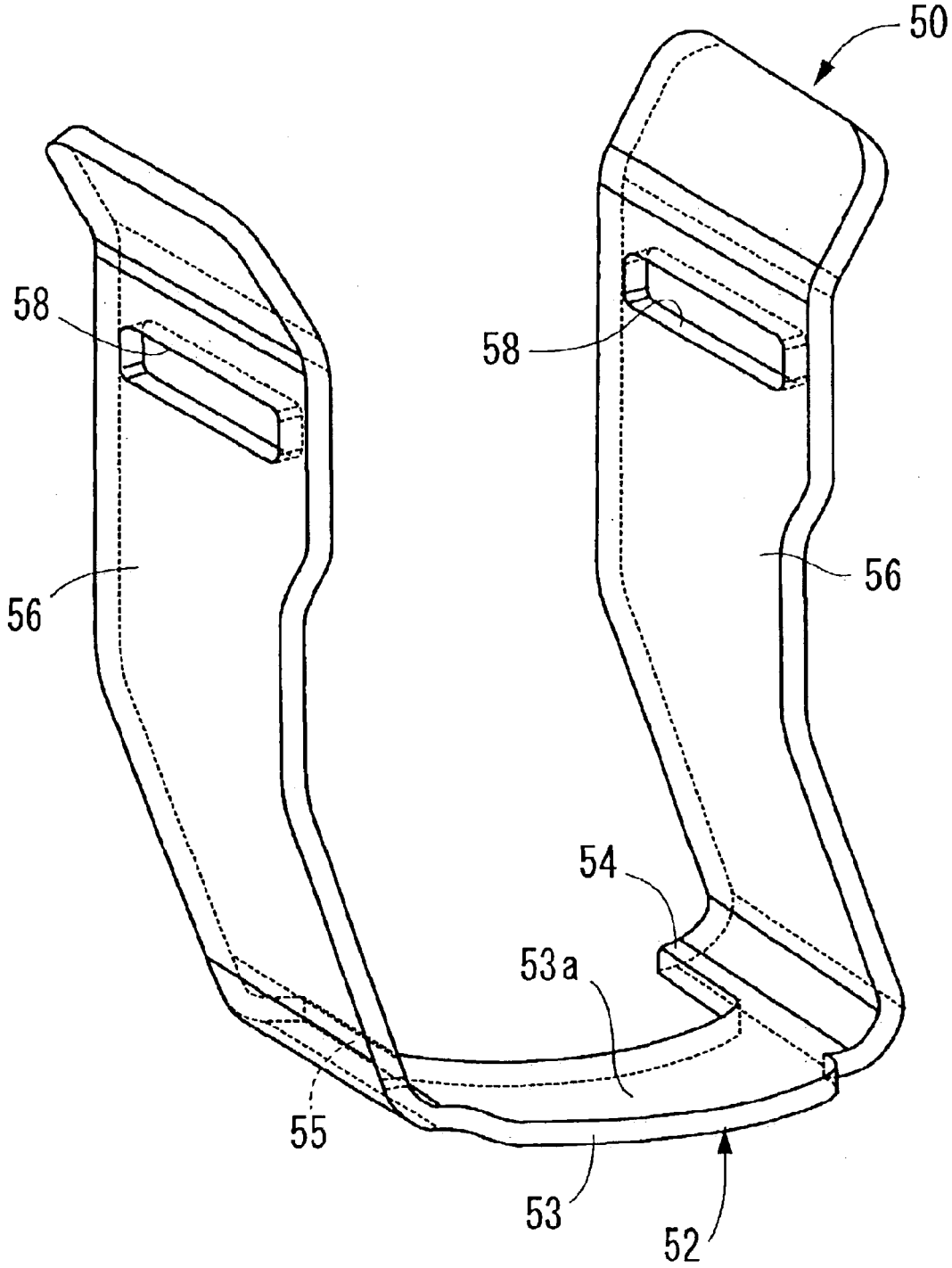
FIG. 4 is a perspective view of a locking clip of the fuel supply unit according to the first embodiment.

The locking clip 50 is made of metal or resin and includes an injector locking portion 52 and two distribution pipe locking portions 56 as shown in FIGS. 1B and 4. The injector locking portion 52 is extended around a half circumference of the fuel injector 30 in a U-shape and fit on the fuel injector 30. A middle portion 53 of the injector locking portion 52 is fit with the injector side surface 35, which is arcuate. Moreover, end portions 54, 55 of the injector locking portion 52 are respectively fit on the injector side surfaces 36, 37, which are flat and parallel to each other. Accordingly, a rotational shift of the fuel injector 30 on the locking clip 50 is restricted, so that a stability of the fuel injector 30 is enhanced.

The end portions 54, 55 of the injector locking portion 52 are respectively integrated with the locking portions 56. In a state where the locking portions 56 are fastened in the fuel outlet port 22, the fuel injector 30 can be shifted in the direction X and an inverse direction thereof within a predetermined range.

As shown in FIG. 2, a plane 53*a* of the middle portion 53, which faces in the inverse direction of the direction X, is parallel to the bottom plane 34*a* of the connector 34, which faces in the direction X. Between the plane 53*a* and the plane 34*a*, a predetermined interval d is provided. The interval d is equal to a length in which the O-ring 39 of the fuel inlet port 31 can be shifted in the direction X without detaching from the fuel outlet port 22. Therefore, even though the injector 30 is shifted in the direction X, the plane 34*a* contacts the plane 53*a* so that the O-ring 39 should not be detached from the fuel outlet port 22. Accordingly, the connector 34 is locked in the injector locking portion 52 of the locking clip 50, which is fastened in the fuel outlet port 22. That is, in this embodiment, the connector 34 serves as a lockable injector portion.

As shown in FIGS. 1B, 4, 6A and 6B, the locking portions 56 respectively extend from the injector locking portion 52 toward the fuel outlet port 22 in parallel, with adjoining to the respective injector side surfaces 36, 37. The locking portions 56 can be elastically deformed. Each locking portion 56 has a rectangular locking hole 58. The lockable projections 26 of the fuel outlet port 22 are respectively fit in the locking holes 58, so that each locking portion 56 is fastened in the circular flange 24 of the fuel outlet port 22.

Next, an assembling procedure of the fuel supply unit 10, in which the fuel injector 30 is installed in the fuel distribution pipe 20, will be described.

(1) As shown in FIG. 7A, the locking clip 50 is mounted on the fuel injector 30 in a direction A so that the fuel injector 30 is placed between the locking portions 56 of the locking clip 50. Moreover, the injector locking portion 52 of the locking clip 50 is fit on the injector side surfaces 35, 36, 37. In this way, the injector locking portion 52 is positioned and installed on the circumferential surface of the fuel injector 30.

(2) As shown in FIG. 7B, the fuel inlet port 39 of the fuel injector 30 is inserted in the fuel outlet port 22 up to a predetermined position in the fuel outlet port 22 in a direction B, with elastically deforming each locking portion 56 in each inversed opposing direction thereof.

(3) By restoring the deformed locking portions 56 with restoring forces thereof, each locking hole 58 is fit in the corresponding lockable projection 26. Accordingly, the locking portions 56 are fastened in the circumferential flange of the fuel outlet port 22, so that the injector 30 is installed in the fuel distribution pipe 20.

By way of above assembling steps (1)–(3), the fuel injector 30 can be securely engaged with the fuel distribution pipe 20 without increasing the manufacturing process thereof. Therefore, assembling efficiency of the fuel supply unit 10 is improved, so that a manufacturing cost thereof can be improved. Moreover, with respect to the assembling steps (1)–(3), the step (2) can be performed previous to the step (1).

In the fuel supply unit 10 assembled through the assembling steps, when the fuel injector 30 is shifted in the direction X by, for example, a mechanical shock caused by the car clash, the middle portion 53 of the injector locking portion 52 locks the connector 34. Therefore, the O-ring 39 of the fuel inlet port 31 is not detached from the fuel outlet port 22. Moreover, when the connector 34 forcedly presses the middle portion 53 in that locking, or when the locking portions 56 are forcedly pulled apart, the locking of the connector 34 can be kept by the middle portion 53, which is extended between the locking portions 56 without breaks. Therefore, a detachment of the fuel injector 30 from the fuel distribution pipe can be surely prevented.

Figure 5:
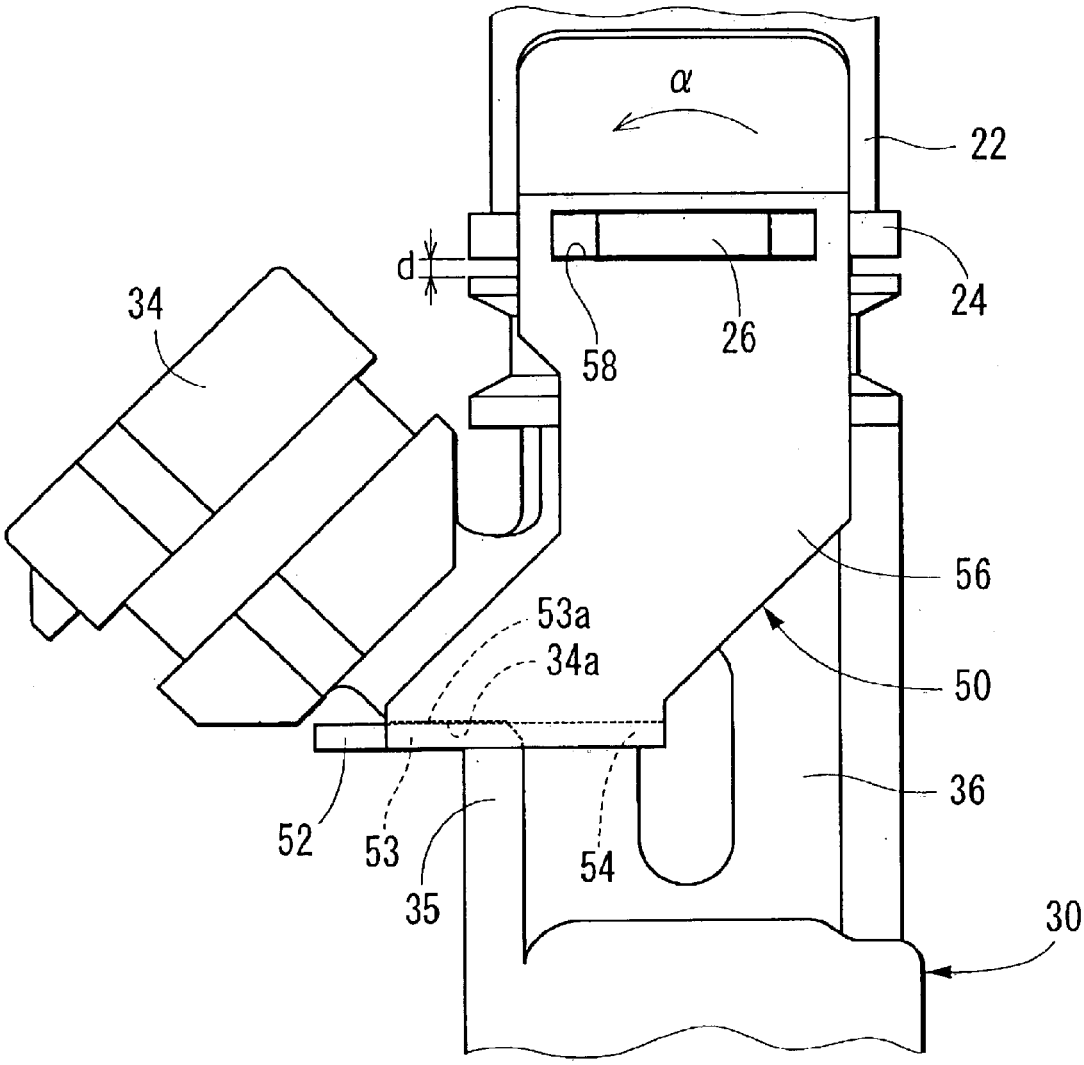
FIG. 5 is a partially enlarged view of a part of the fuel supply unit illustrating an effect of the locking clip of the fuel supply unit according to the first embodiment.
Figure 6A:
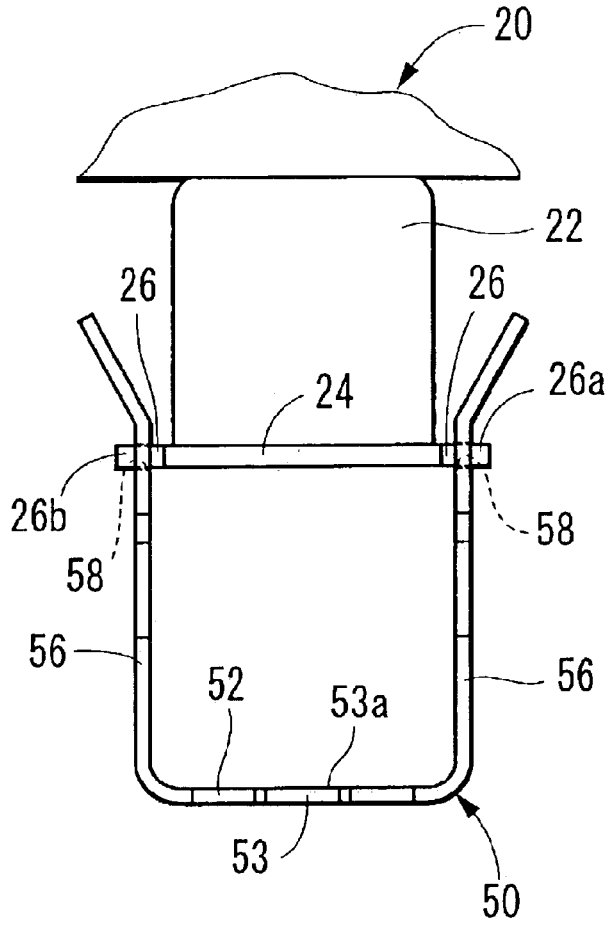
FIGS. 6A and 6B are views showing a state where the locking clip is fit in a fuel outlet port of the fuel distribution pipe of the fuel supply unit according to the first embodiment of the present invention.
Figure 6B:
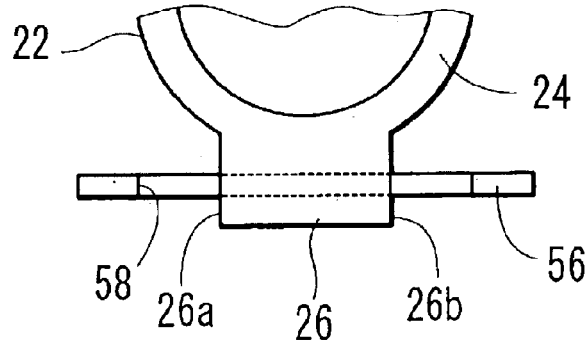

Moreover, as shown in FIG. 5, when a rotational force $\alpha$ around the locking hole 58, which is caused by a contact of the connector 34 and the injector locking portion 52, is generated in the locking clip 50, the lockable projection 26 rotationally presses an inner peripheral surface of the locking hole 58. However, as shown in FIG. 6B, both projection sides of the lockable projection 26 extend in parallel with an extending direction thereof. Therefore, deformations of the lockable projections 26 and the locking hole 58, in which a force that makes the lockable projection 26 detach from the locking holes 58, do not arise. Therefore, a detachment of the fuel outlet port 20 from the locking clip 50 can be surely prevented. Consequently, the fuel injector 30 is surely prevented from detaching from the fuel distribution pipe 20.

Furthermore, the locking between the locking clip 50 and the fuel injector 30 is efficiently realized through the use of the connector 34, which is originally included in the fuel injector 30. Therefore, the manufacturing cost can be reduced.

(Second Embodiment)

Figure 8:
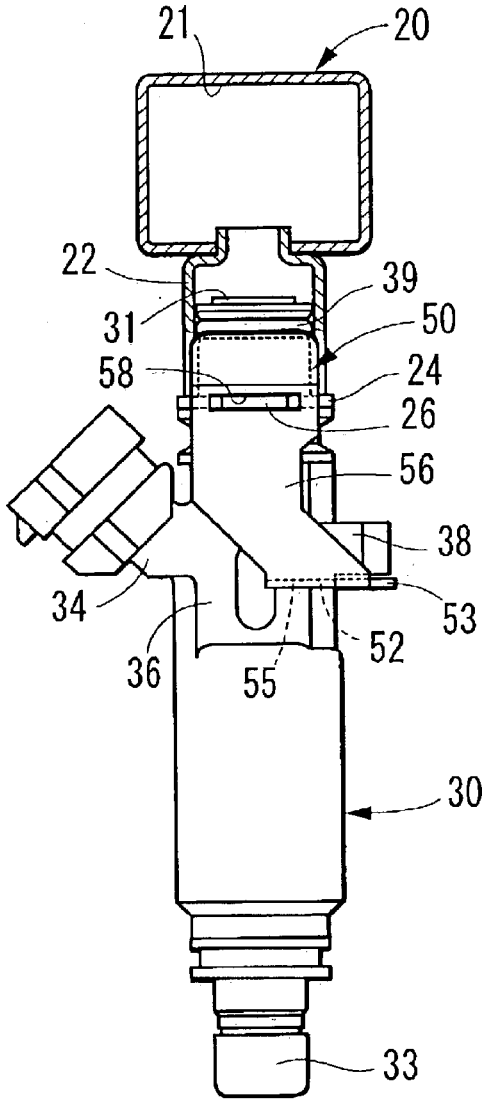
FIG. 8 is a partially cross-sectional side view of a fuel supply unit of a second embodiment according to the present invention.

The connector 34, serving as the lockable injector portion, is provided in the first embodiment. However, as shown in FIG. 8, a lockable injector portion 38 can be provided in the fuel injector 30 in addition to the connector 34. Otherwise, a concave portion serving as the lockable injector portion may be formed in the circumferential surface of the fuel injector 30. In respective structures for locking, a locking mechanism where plane surfaces contact or a locking mechanism where a plane surface and a concave surface contact can be employed.

In the fuel supply unit 10 of the first embodiment, the injector locking portion 52 of the locking clip 50 is fit on the flat and parallel side surfaces 36, 37 of the injector 30, so that the injector locking portion 52 restricts the rotational shift of the fuel injector 30. However, a structure in which the injector locking portion 52 extends around the injector side surfaces 35, 36, 37, with a sufficient clearance thereto can be employed.

(Third Embodiment)

Figure 9:
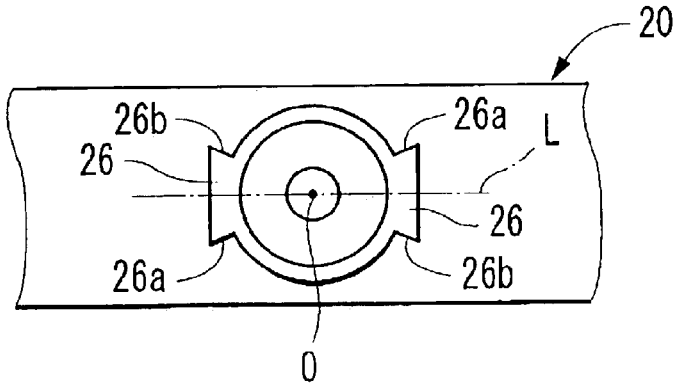
FIG. 9 is a bottom plan view of a fuel distribution pipe of a fuel supply unit of a third embodiment according to the present invention.
Figure 10A:
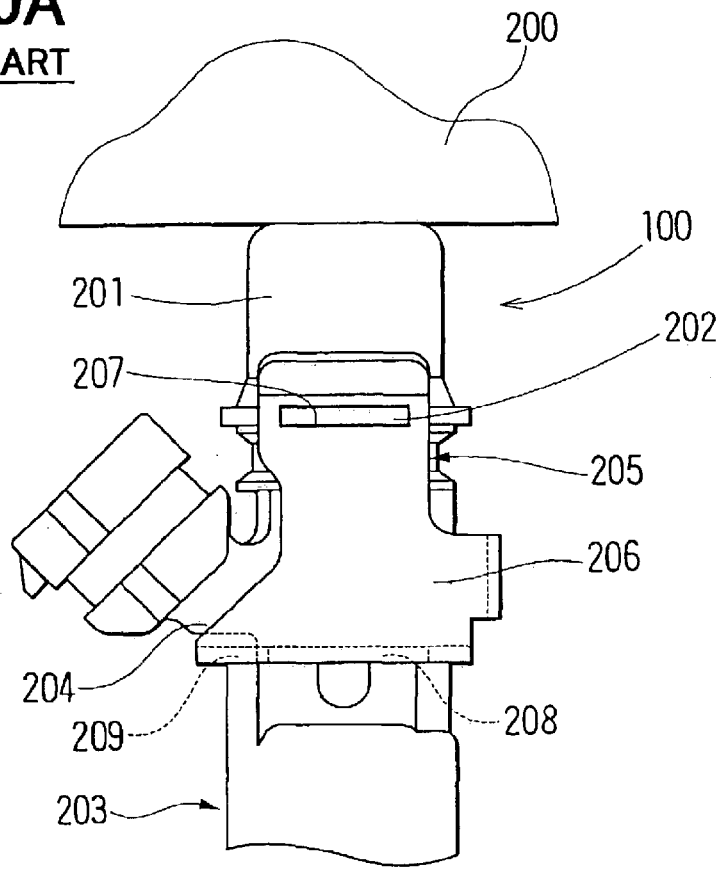
FIG. 10A RELATED ART
FIG. 10A is a side view of a fuel supply unit according to a related art.
Figure 10B:
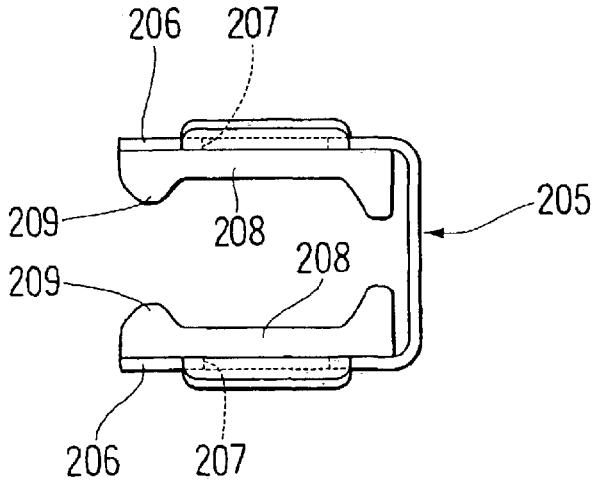
FIG. 10B RELATED ART
FIG. 10B is a plan view of a locking clip of the fuel supply unit according to the related art.
Figure 11A:
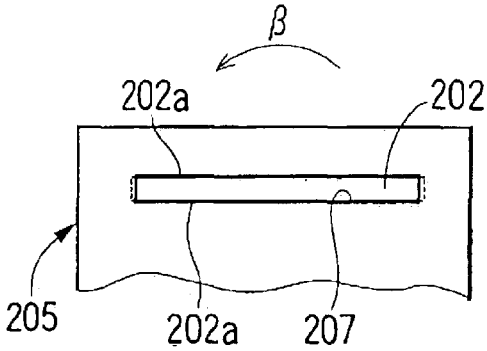
FIG. 11A RELATED ART
FIGS. 11A to 11F are views illustrating an effect of the locking clip according to the related art.
Figure 11B:
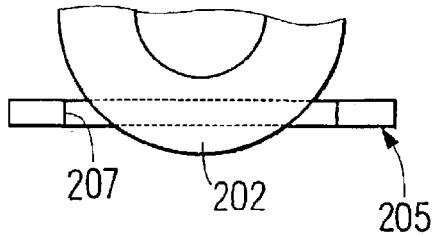
FIG. 11B RELATED ART
Figure 11C:
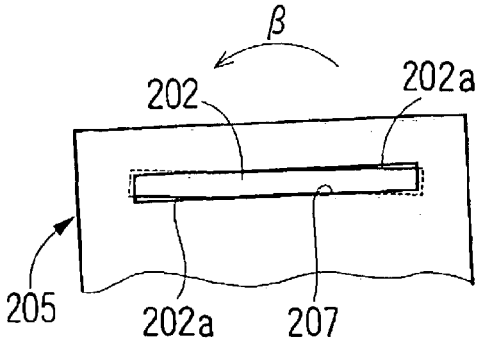
FIG. 11C RELATED ART
Figure 11D:
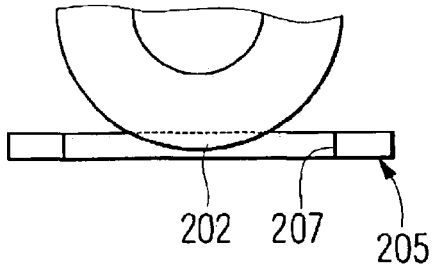
FIG. 11D RELATED ART
Figure 11E:
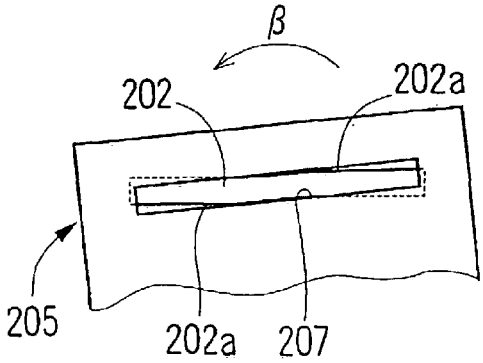
FIG. 11E RELATED ART
Figure 11F:
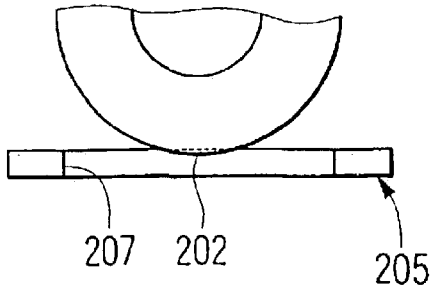
FIG. 11F RELATED ART

Additionally, in the first embodiment, both projection sides 26*a*, 26*b* are formed in parallel with the projecting direction of the lockable projection 26. However, for example, as shown in FIG. 9, the lockable projection 26 may be formed with a shape in which a width thereof becomes larger in the projecting direction thereof.

Moreover, in the first embodiment, the locking clip 50 includes two parallel locking portions 56, which are respectively engaged with the lockable projections 26. However, the locking clip 50 may includes more than two fastening portions around the fuel outlet port 22 to be engaged with the corresponding number of the lockable projections.

Moreover, for locking the locking clip 50 in the fuel outlet port 22, the lockable projections 26 of the fuel outlet port 22 are respectively fit in the locking holes 58 of the locking clip 50 in the first embodiment. However, when the fuel injector 30 and the locking clip 50 are locked in a predetermined shifted position thereof in the axial direction thereof, other conventional structures thereto may be employed.

Furthermore, the fuel supply unit 10 employs both of a locking system between the injector 30 and the locking clip 50 and a locking system between the fuel distribution pipe 20 and the locking clip 50 in the first embodiment. However, one of those locking systems may be employed to the fuel supply unit.

What is claimed is:

1. A fuel supply unit for an engine including at least one cylinder, the fuel supply unit comprising:

a fuel injector for injecting fuel into the cylinder, the fuel injector including a fuel inlet port and a lockable injector portion;

a fuel distribution pipe for distributing fuel to the injector, the fuel distribution pipe including a fuel outlet port communicated with the fuel inlet port of the injector so that the fuel is supplied from the fuel distribution pipe to the fuel injector through the fuel outlet port and the fuel inlet port; and a detachment preventing means for preventing the fuel injector from detaching from the fuel distribution pipe, the detachment preventing means including a single injector locking portion, which continuously extends along a part of a circumferential length of the fuel injector and is engaged with the lockable injector portion of the fuel injector, and two distribution pipe locking portions, each of which extends from a respective side portion of the injector locking portion toward the fuel outlet port and is engaged with a circumference of the fuel outlet port, so that the fuel inlet port will not be detached from the fuel outlet port when the fuel injector is shifted in a detaching direction thereof.

2. The fuel supply unit according to claim 1, wherein the lockable injector portion is formed in a circumferential surface of the fuel injector and projects in a radial direction thereof.

3. The fuel supply unit according to claim 1, wherein the injector locking portion is fit on a circumferential surface of the fuel injector, so that a diametrical shift of the fuel injector is restricted.

4. The fuel supply unit according to claim 1, wherein:

the fuel outlet port includes two lockable projections, each of which projects in a corresponding radial direction thereof from an outer circumference thereof;

each one of the distribution pipe locking portions has a locking hole, in which the corresponding lockable projection fits;

each one of the lockable projections fits in the locking hole of the corresponding distribution pipe locking portion; and both projection sides of each lockable projection are formed in parallel with the diametrical direction thereof or formed so that width of each lockable projection becomes larger in a radial direction thereof.

5. A fuel supply unit for an engine including a cylinder, the fuel supply unit comprising:

a fuel injector for injecting fuel into the cylinder, the fuel injector including a fuel inlet port;

a fuel distribution pipe for distributing fuel to the injector, the fuel distribution pipe including a fuel outlet port communicated with the fuel inlet port of the injector so that the fuel is supplied from the fuel distribution pipe to the fuel injector through the fuel outlet port and the fuel inlet port; and a detachment preventing means, which is for preventing the fuel injector from detaching from the fuel distribution pipe and for locking the fuel distribution pipe and the fuel injector when the fuel injector is shifted in a detaching direction thereof from the fuel outlet port, and which includes a plurality of distribution pipe locking portions disposed around a circumference of the fuel outlet port, wherein each distribution pipe locking portion has a locking hole, wherein the fuel outlet port includes a plurality of lockable projections for respectively engaging with the locking holes, each of which projects in a radial direction of the fuel outlet port from an outer circumference thereof; and both sides of each lockable projection are in parallel with a diametrical direction of the fuel outlet port or formed so that width of each lockable projection gets larger in a radial direction thereof.

6. An assembling method of the fuel supply unit according to claim 1, the assembling method comprising steps of:

installing the fuel injector between the distribution pipe locking portions of the detachment preventing means, wherein the injector locking portion are aside of the circumferential surface of the fuel injector; and broadening an interval of the distribution pipe locking portions by deforming, and engaging each of the distribution pipe locking portions with the circumference of the fuel outlet port by force of the distribution pipe locking portions.

7. A fuel supply unit for an engine including at least one cylinder, comprising:

a fuel distribution pipe for distributing fuel, the fuel distribution pipe including a plurality of engagement parts extending in a radial direction on an outer circumference thereof;

a fuel injector for injecting into the cylinder the fuel supplied from the distribution pipe, the fuel injector including a projection extending on an outer circumference thereof in a direction perpendicular to a longitudinal axis of the fuel injector;

a clip for coupling the fuel distribution pipe and the fuel injector, the clip including a plurality of pipe locking parts engaged with the engagement parts of the fuel distribution pipe at top ends thereof and extending in a longitudinal direction of the fuel injector, and the clip further including an injector locking part unitary connecting bottom ends of the pipe locking parts at a bottom side of the engagement part of the fuel injector and continuously extending in a direction perpendicular to the longitudinal axis of the fuel injector within an angular range of less than one half of a circumference of the fuel injector being in contact with the projection at one side thereof opposite to the fuel distribution pipe.

8. The fuel supply unit according to claim 7, wherein the injector locking part is spaced a predetermined distance from the bottom side of the engagement part of the fuel injector.

9. The fuel supply unit according to claim 7, wherein the fuel injector includes a pair of flat side walls in parallel with each other and arcuate side walls between the fiat side walls, the pipe locking parts face the flat side walls respectively, and the injector locking part continuously surrounds only one of the arcuate side walls in a circumferential direction of the fuel injector.

10. A fuel supply unit for an engine including at least one cylinder, the fuel supply unit comprising:

a fuel injector for injecting fuel into the cylinder, the fuel injector including a fuel inlet port, a lockable injector portion and a pair of flat side walls in parallel with each other;

a fuel distribution pipe for distributing fuel to the injector, the fuel distribution pipe including a fuel outlet port communicated with the fuel inlet port of the injector so that the fuel is supplied from the fuel distribution pipe to the fuel injector through the fuel outlet port and the fuel inlet port; and a locking component including an injector locking portion, which is formed to bind the two flat side wails therein in a circumferential direction of the fuel injector and is engaged with the lockable injector portion of the fuel injector, and a pair of distribution pipe locking portions, each of which extends from a respective side portion of the injector locking portion toward the fuel outlet port and is engaged with a circumference of the fuel outlet port so that the fuel inlet port will not be detached from the fuel outlet port when the fuel injector is shifted in a detaching direction thereof.

11. The fuel supply unit according to claim 10, wherein the lockable injector portion is formed in a circumferential surface of the fuel injector and projects in a radial direction thereof.

12. The supply unit according to claim 10, wherein:

the fuel outlet port includes two lockable projections, each of which projects in a corresponding radial direction thereof from an outer circumference thereof; and each one of the distribution pipe locking portions has a locking hole, in which the corresponding lockable projection fits.

13. The fuel supply unit according to claim 10, wherein the fuel injector includes arcuate side walls between said flat side walls and wherein the injector locking portion extends radially from solely one of the arcuate side walls.

14. A fuel supply unit for an engine including a cylinder, the fuel supply unit comprising:

a fuel injector for injecting fuel into the cylinder, the fuel injector including a fuel inlet port and a lockable injector portion formed on a circumferential surface of the fuel injector and projecting in a radial direction thereof;

a fuel distribution pipe for distributing fuel to the injector, the fuel distribution pipe including a fuel outlet port communicated with the fuel inlet port of the injector and a plurality of lockable projections each of which projects in a radial direction of the fuel outlet port from an outer circumference thereof; and a detachment preventing means including an injector locking portion, which continuously extends along a part of a circumferential length of the fuel injector and is engaged with the lockable injector portion of the fuel injector, and a plurality of distribution pipe locking portions, each of which extends from a respective side portion of the injector locking portion toward the fuel outlet port and has a locking hole engaged with the lockable projection so that the fuel inlet port will not be detached from the fuel outlet port, wherein both sides of each lockable projection are in parallel with a diametrical direction of the fuel outlet port or formed so that a width of each lockable projection gets larger in a radial direction thereof.

* * * * *